US006643945B1

(12) United States Patent
Starks

(10) Patent No.: US 6,643,945 B1
(45) Date of Patent: Nov. 11, 2003

(54) UNIVERSAL ANCHOR BOLT TEMPLATE

(76) Inventor: William Starks, 1012 Woodbridge Dr., Las Vegas, NV (US) 89108

( * ) Notice: Subject to any disclaimer, the term of this patent is extended or adjusted under 35 U.S.C. 154(b) by 0 days.

(21) Appl. No.: 10/197,054

(22) Filed: Jul. 16, 2002

Related U.S. Application Data

(63) Continuation-in-part of application No. 09/535,034, filed on Mar. 24, 2000.

(51) Int. Cl.[7] ..... G01B 3/14; B43L 7/027

(52) U.S. Cl. ..... 33/566; 33/562; 33/474; 33/518; 248/207

(58) Field of Search ..... 33/1 G, 196, 197, 33/474, 476, 518, 526, 562, 563, 566; 249/207

(56) References Cited

U.S. PATENT DOCUMENTS

| | | | | | |
|---|---|---|---|---|---|
| 44,738 | A | * | 10/1864 | Nelson | 33/562 |
| 1,796,400 | A | * | 3/1931 | Rush | 249/207 |
| 3,552,734 | A | * | 1/1971 | Severino et al. | 249/207 |
| 3,912,218 | A | * | 10/1975 | Lister | 249/207 |
| 3,963,210 | A | | 6/1976 | Macklin | 249/210 |
| 4,177,569 | A | * | 12/1979 | Greer | 33/562 |
| 4,357,755 | A | | 11/1982 | Allen et al. | 33/180 |
| 4,461,086 | A | * | 7/1984 | Segletes | 33/563 |
| 4,932,818 | A | | 6/1990 | Garwood | 411/366 |
| 6,243,961 | B1 | * | 6/2001 | Winski | 33/474 |
| 6,343,632 | B1 | * | 2/2002 | Zivojinovic | 33/197 |
| 6,578,282 | B2 | * | 6/2003 | Haegele et al. | 33/563 |

* cited by examiner

*Primary Examiner*—G. Bradley Bennett
(74) *Attorney, Agent, or Firm*—Goldstein & Lavas, P.C.

(57) ABSTRACT

A universal anchor bolt template including a plate member having a square configuration. The plate member has planar upper and lower surfaces. The plate member has a plurality of apertures therethrough arranged in at least one group of four radial aperture lines. The apertures are spaced along each of the aperture lines in the group at corresponding distances, such that the use of corresponding apertures allows the anchoring bolts to be positioned in a square configuration with a selected center-to-center distance. Each of the apertures is surrounded by at least one concentric knock-out for allowing the apertures to be enlarged for the use of larger anchoring bolts than could be accommodated by the apertures.

8 Claims, 3 Drawing Sheets

UNIVERSAL ANCHOR BOLT TEMPLATE

CROSS REFERENCES AND RELATED SUBJECT MATTER

This application is a continuation-in-part of patent application Ser. No. 09/535,034, filed in the United States Patent Office on Mar. 24, 2000.

BACKGROUND OF THE INVENTION

The present invention relates to a universal anchor bolt template and more particularly pertains to allowing for allowing the placement of a plurality of anchor bolts sizes prior to pouring concrete, and allowing the anchor bolts to be placed at various center-to-center distances, thereby eliminating the need for a special template for the specific distances required.

The use of positioning systems is known in the prior art. More specifically, positioning systems heretofore devised and utilized for the purpose of setting anchor bolts in concrete are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,932,818 to Garwood discloses a positioning system for setting anchor bolts in concrete foundations comprised of a template for holding the bolt at a right angle. U.S. Pat. No. 3,963,210 to Machlin discloses means for setting anchor bolts and is comprised of a plate with four spaced bores and elongated legs.

U.S. Pat. No. 4,357,755 to Allen et al. discloses a column pad layout device, and bolt layout device. However, once the layout is determined, Allen still relies on a specific template for the center-to-center size needed.

In addition, often it is necessary to center an electrical conduit between a square arrangement of anchor bolts. For example, when pouring a footing for a light post, an electrical conduit must typically extend upward from the ground through the concrete, centered. bet ween the anchor bolts. However, common pre-set templates do not allow for an electrical conduit.

While these devices fulfill their respective, particular objective and requirements, the aforementioned patents do not describe a universal anchor bolt template for allowing for the use of a plurality of anchor bolts sizes and a plurality of square sizes.

In this respect, the universal anchor bolt template according to the present invention substantially departs from the conventional concepts and designs of the prior art, and in doing so provides an apparatus primarily developed for the purpose of allowing for the use of a plurality of anchor bolts sizes and a plurality of square sizes.

Therefore, it can be. appreciated that there exists a continuing need for a new and improved universal anchor bolt template which can be used for allowing for the use of a plurality of different anchor bolts sizes and allows their placement at a plurality of "square" arrangements having different center-to-center distances. In this regard, the present invention substantially fulfills this need.

SUMMARY OF THE INVENTION

In the view of the foregoing disadvantages inherent in the known types of positioning systems now present in the prior art, the present invention provides an improved universal anchor bolt template. As such, the general purpose of the present invention, which will be described subsequently in greater detail, is to provide a new and improved universal anchor bolt template which has all the advantages of the prior art and none of the disadvantages.

To attain this, the present invention essentially comprises a plate member having a square configuration. The plate member has planar upper and lower surfaces. The plate member has a plurality of bolt apertures therethrough. Each of the apertures has at least one knock-out concentric therewith, which is selectively removed for allowing a larger diameter anchor bolt than permitted by the anchor bolt. The plurality of apertures are arranged on the plate member in a spaced relationship whereby several squares of different "corner-to-corner" distances may be formed by joining four of the apertures, each square representing a different "center-to-center" distances for bolts placed in the apertures.

There has thus been outlined, rather broadly, the more important features of the invention in order that the detailed description thereof that, follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved universal anchor bolt template which has all the advantages of the prior art positioning systems and none of the disadvantages. It is another object of the invention to provide an anchor bolt placement template which allows various sized bolts to be accommodated, and allows their accurate placement at various center-to-center distances. Accordingly, the template has a center, and has at least one set of four radial aperture lines, the apertures are located along the aperture lines at consistent placements among the four aperture lines, thereby providing several concentric squares by the connection of corresponding apertures along the radial aperture lines.

It is yet another object of the present invention to provide a new and improved universal anchor bolt template which may be easily and efficiently manufactured and marketed, and may be reused.

It is a further object of the present invention to provide a new and improved universal anchor bolt template which is of durable and reliable construction.

It is still a further object of the invention to allow precise placement of the template itself. Accordingly, a center hole is provided to allow the template to be suitably placed.

An even further object of the invention is to provide a template which allows a vertically extending electrical conduit to be centered between the bolts. Accordingly, a conduit knock-out is provided which may be removed to allow a conduit to be placed prior to pouring concrete beneath the template.

Lastly, it is an object of the present invention to provide a new and improved universal anchor bolt template including a plate member having a square configuration. The plate member has planar upper and lower surfaces. The plate member has a plurality of apertures therethrough, each surrounded by at least one concentric knock-out for selectively allowing larger anchor bolt sizes. The plurality of apertures are arranged on the plate member in a spaced relationship whereby a plurality of squares are may be formed by joining four of the apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to FIGS. 1 through 5 thereof, the preferred embodiment of the new and improved universal anchor bolt template embodying the principles and concepts of the present invention and generally designated by the reference number 10 will be described.

Specifically, it will be noted in the various FIGS. that the device relates to a universal anchor bolt template for allowing for the use of a plurality of anchor bolts sizes and for positioning them in a square configuration at a plurality of center-to-center distances. In its broadest context, the template is a plate member having a plurality of apertures. Such components are individually configured and correlated with respect to each other so as to attain the desired objective.

Figure 1:
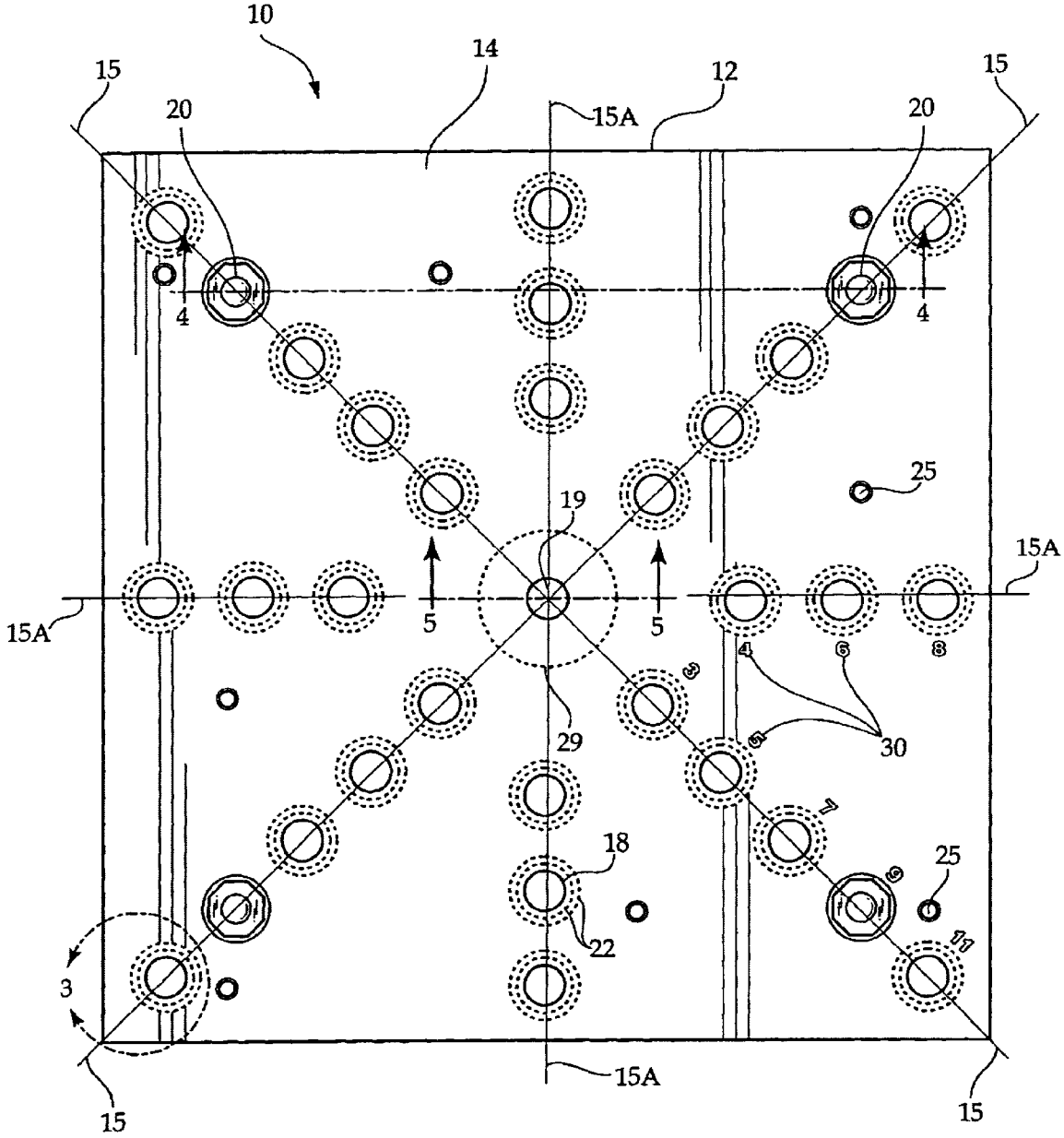
FIG. 1 is a plan view of the preferred embodiment of the universal anchor bolt template constructed in accordance with the principles of the present invention.
Figure 2:
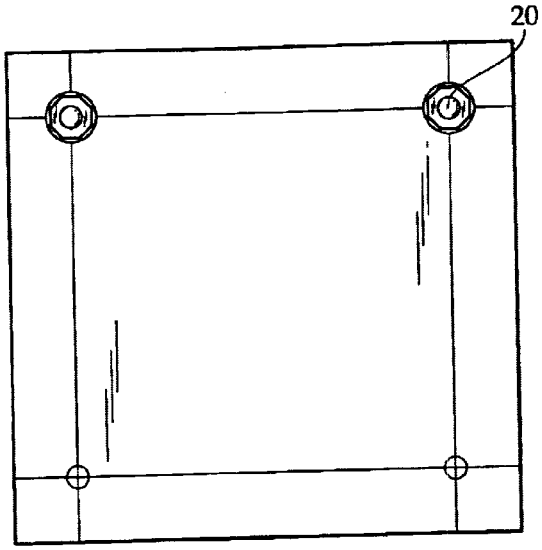
FIG. 2 (PRIOR ART)
FIG. 2 is a plan view a prior art template illustrated in use.

FIG. 2 illustrates a prior art anchor bolt placement template. It is fabricated to have four holes which accommodate anchoring bolts 20 in a square configuration having only that specific center-to-center distance.

Figure 3:
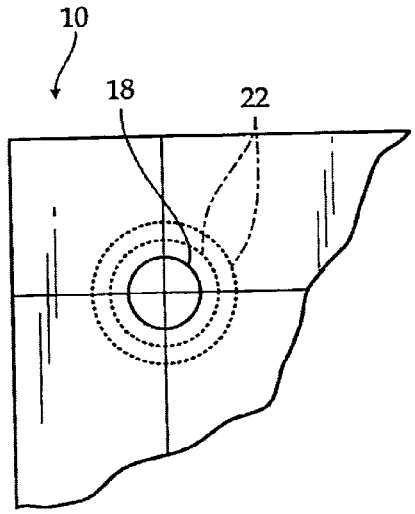
FIG. 3 is a sectional plan view of the present invention as taken from circle 3 of FIG. 1, illustrating one aperture and concentric aperture knock-outs.

The plate member 12.has a square configuration having a plate center. The plate member 12 has planar upper and lower surfaces 14,16. The plate member 12 has a plurality of apertures 18 therethrough. Each of the apertures 18 is sized to for receiving at least one size of anchor bolt 20 therethrough. Referring to FIG. 3, each of the apertures 18 has at least one concentric aperture knock-out 22, which is stamped, scored, or otherwise configured, so that it may be removed to enlarge the size of the aperture, to accommodate a larger anchor bolt. For example, each aperture 18, along with an enlarged aperture created by selectively removing two larger concentric cut-outs 22 may accommodate anchor bolts 20 sized as ⅝", ¾", and ⅞" diameter.

The plurality of apertures 18 are arranged on the plate member 12 along radial aperture lines 15 extending from the plate center. At least one group of four radial aperture lines 15 is provided, wherein the apertures 18 are consistently spaced along those four radial aperture lines 15. Accordingly a plurality of squares are formed by joining four corresponding apertures 18 along the grouped radial. aperture, lines.

Preferably, two groups of four radial aperture lines 15 are provided, to allow the greatest selection of center-to-center distances for the square arrangement of anchor bolts. Such center-to-center distances are Preferably provided by embossed indicia 30. As illustrated center-to-center distances of 3", 4", 5", 6", 7", 9", and 11" are provided. The use of a second group of four secondary radial aperture lines 15A having apertures 18 located at different radial distances than the apertures on the first group of radial aperture lines 15, allows bolts approximating 1 inch to be used, even when both 3 inch, and 4 inch center-to-center distances are permitted by the template 10. The plurality of apertures 18 are arranged on the plate member 12 in nine different square arrangements. The nine different square arrangements, have a side ranging from three inches to eleven inches. In addition a central aperture 19 is provided, which allows the plate to be suitably positioned when the center of the square to be formed by the bolts is known.

Figure 4:
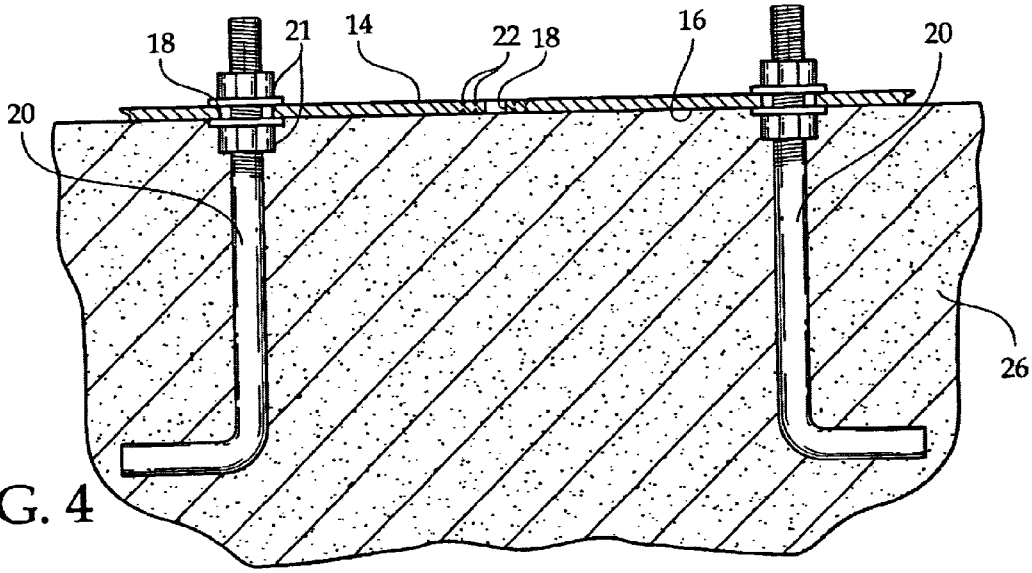
FIG. 4 is a cross-sectional view of the present invention illustrated in use as taken along line 4—4 of FIG. 1.
Figure 5:
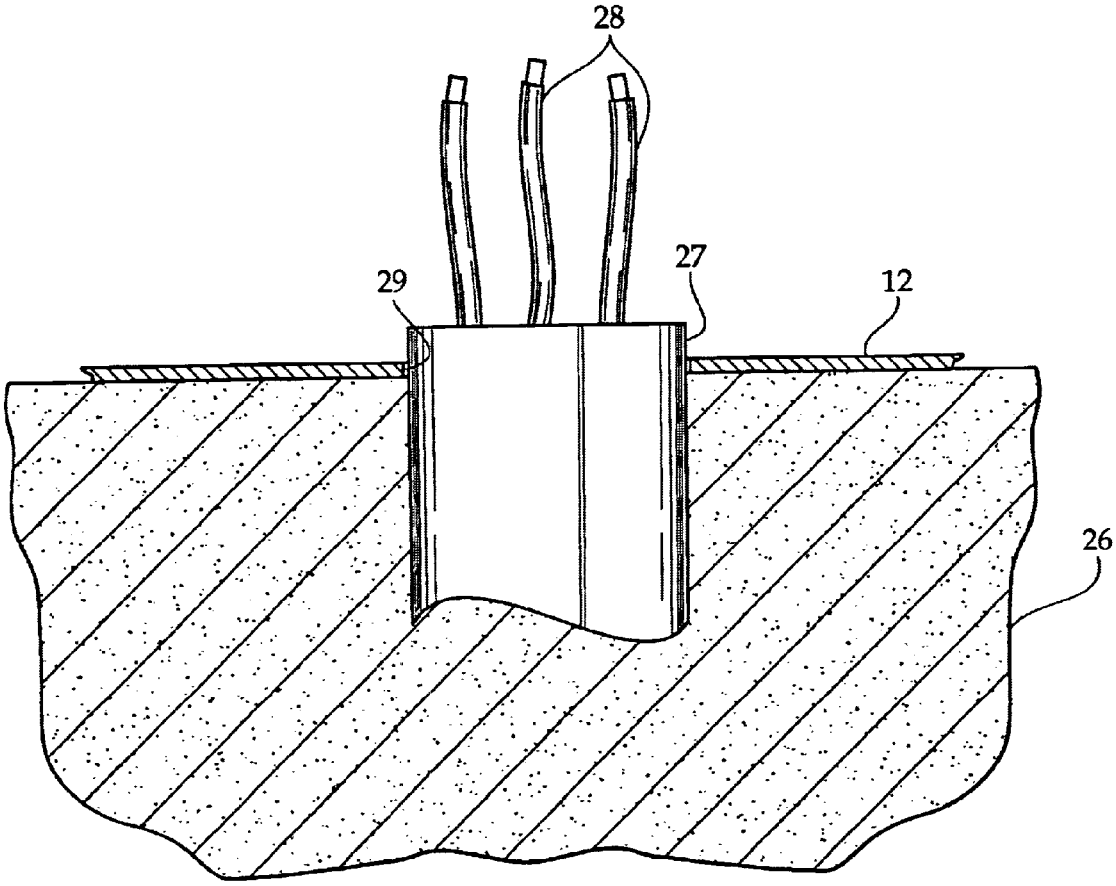
FIG. 5 is a cross sectional view, taken generally along line 5—5 in FIG. 1, except wherein the conduit knock-out has been removed and has allowed an electrical conduit to be centrally positioned.

In use, the user then decides which center-to-center distance is required (as specified typically by the construction plans and the I-beam or other item to be mounted to the anchor bolts). Apertures 18 are selected according to such requirements. The user then decides the size of anchor bolts that are to be used. If necessary the selected apertures are enlarged by removing one or more cut-outs 22 concentric with the selected apertures. The anchor bolts are then placed through the appropriate cut-out of the apertures 18 that form the corners of a of square having sides equal to the required center-to-center distance. The anchor bolts are generally mounted to the plate using a pair of nuts 21. Typically one nut 21 is placed against the top surface of the plate and another nut is placed against the bottom surface of the plate. The template is suitably placed upon the concrete form. The nails holes 25 may be used to fasten the template in place, depending on surrounding structure to which it may be attached. The concrete may be poured to form a slab which encases the anchoring bolts 20, as seen in FIG. 4. Upon the drying of the slab 26, the nuts 21 above the plate are removed from the anchoring bolts 20, and the plate member 12 can be removed for subsequent use.

In addition, the present invention allows an electric conduit 27 to be placed centrally between the anchoring bolts. In particular, referring to FIG. 1, the template 10 has a conduit knock-out 29, concentric with the plate center, which may be removed to allow an electrical conduit 27 to be positioned with the plate, whereby upon hardening of the concrete 26, the electrical conduit 27 will extend upward therefrom, centered between the bolts, and allows electrical wires 28 to extend therethrough. The central aperture 19 is located within the conduit knock-out, also concentric with the plate center and is accordingly smaller in diameter than the conduit knock-out. Generally, the conduit knock-out would be substantially two inches in diameter (or slightly larger), to accommodate a standard two inch diameter electrical conduit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the united states is as follows:

1. A universal anchor bolt template for allowing for the use of anchor bolts having different sizes, for placement within concrete in a square configuration at various selected center-to-center distances, comprising, in combination:

a plate member having a square configuration having a center, the plate member having planar upper and lower surfaces, the plate member having a plurality of apertures therethrough, the plate member having at least one group of four radial aperture lines, the radial aperture lines formed by the apertures, wherein the apertures are consistently spaced along the radial aperture lines of the group, such that the apertures each form a square by with corresponding apertures on the other radial aperture lines of the group, wherein at least one concentric knock-out is located concentric with the aperture which may be selectively removed to enlarge the aperture to accommodate a larger diameter anchoring bolt than that accommodated by the aperture.

2. The universal anchor bolt template as recited in claim 1, wherein a conduit knock-out is located on the plate member, concentric with the plate center, the conduit-knock out may be selectively removed to allow a conduit pipe to extend vertically upward through the plate so that it is centered between anchoring bolts placed through corresponding apertures on the radial aperture lines.

3. The universal anchor bolt template as recited in claim 2, wherein the conduit knock-out further has a central aperture, smaller than the conduit knock-out and concentric with the center of the plate for facilitating alignment of the plate.

4. The universal anchor bolt template as recited in claim 3, further comprising a second group of radially extending aperture holes, which have holes spaced at different center-to-center distances than the apertures on the other group of radially extending aperture holes.

5. The universal anchor bolt as set forth in claim 4, wherein the apertures along the radial aperture lines, along with two selectively removable knock-outs. formed around the aperture will selectively accommodate for anchor bolts substantially ⅝", ¾", and ⅞" in diameter, and wherein the conduit knock-out is substantially 2 inches in diameter.

6. The universal anchor bolt template as set forth in claim 5, wherein the apertures are arranged to allow a square configuration of anchoring bolts to be positioned at a center-to-center distance of between 3 and 11 inches.

7. The universal anchor bolt template as recited in claim 6, wherein the plate upper surface has embossed numeral indicia which indicates which holes are to be used for various center-to-center distances selected by the user.

8. The universal anchor bolt template as recited in claim 7, further comprising nail holes, which allow the plate to be secured to a form into which the concrete is poured to fix the position of the plate.

* * * * *